US008440930B2

(12) United States Patent
Lee

(10) Patent No.: US 8,440,930 B2
(45) Date of Patent: May 14, 2013

(54) VACUUM CIRCUIT BREAKER

(75) Inventor: Dong Sik Lee, Chungcheongbuk-Do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 331 days.

(21) Appl. No.: 12/980,160

(22) Filed: Dec. 28, 2010

(65) Prior Publication Data

US 2011/0155696 A1 Jun. 30, 2011

(30) Foreign Application Priority Data

Dec. 31, 2009 (KR) ..... 10-2009-0136229

(51) Int. Cl.
*H01H 33/666* (2006.01)

(52) U.S. Cl.
USPC ..... 218/140; 218/154

(58) Field of Classification Search ..... 218/140, 218/7, 14, 120, 152–154
See application file for complete search history.

(56) References Cited

U.S. PATENT DOCUMENTS

| | | | | |
|---|---|---|---|---|
| 4,064,383 | A | 12/1977 | Barkan | |
| 4,150,270 | A * | 4/1979 | Zunick | 218/138 |
| 6,198,062 | B1 * | 3/2001 | Mather et al. | 218/152 |
| 7,829,814 | B2 * | 11/2010 | Marchand et al. | 218/140 |
| 2002/0067230 | A1 | 6/2002 | Yoon | |

FOREIGN PATENT DOCUMENTS

| | | |
|---|---|---|
| CN | 1357902 | 7/2002 |
| DE | 19753177 | 5/1999 |
| JP | 50-112964 | 9/1975 |
| JP | 63-182035 | 11/1988 |
| JP | 6-103863 | 4/1994 |
| JP | 2002216597 | 8/2002 |
| KR | 1020020043787 | 6/2002 |

OTHER PUBLICATIONS

In the Japanese Patent Office Application Serial No. 2010-291103, Notice of Allowance dated Sep. 18, 2012, 2 pages.
The State Intellectual Property Office of the People's Republic of China Application Serial No. 201010622366.4, Office Action dated Mar. 4, 2013, 7 pages.

* cited by examiner

*Primary Examiner* — Tulsidas C Patel
*Assistant Examiner* — Marina Fishman
(74) *Attorney, Agent, or Firm* — Lee, Hong, Degerman, Kang & Waimey

(57) ABSTRACT

Disclosed is a vacuum circuit breaker. A rotation link provided between a rotation shaft which transfers a rotation force of a driving force, and a moveable link which performs a linear motion by a rotation force of the rotation shaft is configured to receive a tensile force to be pulled to a direction of the rotation shaft when a driving unit performs a closing operation. This may prevent the moveable link from being buckled during a closing operation, and thus prevent lowering of the reliability due to deformation of sliding levers.

18 Claims, 6 Drawing Sheets

VACUUM CIRCUIT BREAKER

CROSS-REFERENCE TO A RELATED APPLICATION

Pursuant to 35 U.S.C. §119(a), this application claims the benefit of earlier filing date and right of priority to Korean Application 10-2009-0136229, filed on Dec. 31, 2009, the content of which is incorporated by reference herein in its entirety.

BACKGROUND OF THE INVENTION

1. Field of the Invention

The present invention relates to a vacuum circuit breaker used in a system to distribute electricity for industry, and particularly, to a vacuum circuit breaker in which a main circuit part and a mechanic part are arranged in a longitudinal direction.

2. Background of the Invention

Generally, a circuit breaker is an electricity protecting apparatus capable of protecting a load device and a line from a large current due to a shortening, a ground accident, etc. that may occur on an electric circuit. When an accident circuit occurs, the circuit breaker opens a circuit by automatically performing a breaking operation.

One type of the circuit breaker, a vacuum circuit breaker is configured to rapidly opens a circuit by extinguishing, in a vacuum container, an arc generated when opening/closing a normal load and when breaking an accident current.

FIGS. 1 and 2 are a perspective view showing one example of a vertical type vacuum circuit breaker in accordance with the conventional art.

As shown, the conventional vertical type vacuum circuit breaker comprises a main circuit part 10 having a fixed contact 12 and a moveable contact 14, and configured to conduct a main circuit and to break an abnormal current; a mechanical part 20 configured to generate an operational force so as to connect the circuit between the two contacts 12 and 14 of the main circuit part 10 to each other, or to disconnect the circuit from each other; a link frame 30 long installed below the mechanical part 20 and the main circuit part 10 in back and forth directions; and a link unit 40 provided in the link frame 30, and configured to convert one rotation motion into a plurality of vertical motions while moving in back and forth directions so as to transfer an operation force of the mechanical part 20 to the moveable contact 14 of the main circuit part 10.

The main circuit part 10 consists of three for R, S and T phases, and is fixedly-installed in a vertical direction above the link frame 30 from a backside of the mechanical part. Each of the main circuit parts 10A, 10B and 10C includes a main circuit housing 11 installed above the link frame 30 in a vertical direction, a fixed contact 12 positioned at an inner upper part of the main circuit housing 11, an insulation rod 13 connected to the link unit 40 and vertically moveable in the main circuit housing 11, and a moveable contact 14 fixed to an upper end of the insulation rod 13 and contacting or separated from the fixed contact 12 while vertically moving.

The link unit 40 includes a rotation shaft 41 provided in the mechanical part 20, a rotation link 42 configured to convert a rotation motion of the rotation shaft 41 into a motion force in back and forth directions, a moveable link 43 having a fore end rotatably connected to the rotation link 42 and movable in back and forth directions by being long connected to inside of the link frame 30, and three direction conversion links 44 sequentially connected to the three main circuit parts 10 above the moveable link 43, and configured to convert motion in back and forth directions into a vertical motion.

The moveable link 43 includes a sliding lever 45 implemented as two long bars are fixed with a predetermined gap therebetween, and a guide link disposed between the two bars of the sliding lever 45, configured to transfer a horizontal motion force of the sliding lever 45 to the direction conversion links 44, and configured to provide a suitable compression force to the direction conversion links 44.

The guide link 46 includes a guide rod 47 having both ends rotatably connected to the sliding lever 43 and the direction conversion links 44, and capable of performing a relative motion in back and forth direction with respect to the direction conversion links 44, and a contact pressing spring 48 supported by the guide rod 47 and configured to provide an elastic force in a direction to perform a relative motion with respect to the direction conversion links 44.

Unexplained reference numeral 49 denotes a connection lever of a rotation link.

The operation of the conventional vertical type vacuum circuit breaker will be explained as follows.

Once the rotation shaft 41 rotates by an operation of the mechanical part 20, the rotation link 42 coupled to the rotation shaft 41 rotates, and the moveable link 43 moves to a rear side, i.e., to a direction far from the rotation shaft 41. As a result, the three direction conversion links 44 simultaneously rotate.

As upper parts of the direction conversion links 44 rotate, each insulation rod 13 vertically moves upwardly in the main circuit part 10 to push up the moveable contact 14 thereby to contact the moveable contact 14 to the fixed contact 12. Accordingly, an operation force of the mechanical part 20 is transferred to the main circuit part 10 to allow a main circuit to be closed.

When the movable link 43 transfers the motion force received from the mechanical part 20 in back and forth directions, the same force and speed are provided to each direction conversion link 44 connected to the link frame 30 with the same interval. This may allow the moveable contact 14 and the fixed contact 12 inside each main circuit part 10A, 10B and 10C to contact each other with the same force.

If the rotation shaft 41 continues to rotate by an operational force of the mechanical part 20 even in a state that the moveable contact 14 and the fixed contact 12 come in contact with each other, the moveable link 43 also continues to move backwardly. Then, the moveable link 43 compresses the contact pressing spring 48, and the guide rod 47 rotates the moveable link 43 in a state that the contact pressing spring 48 maintains an elastic force. Accordingly, the insulation rod 13 is upwardly moved. As the moveable contact 14 and the fixed contact 12 have a suitable contact force therebetween by the elastic force provided to the direction conversion links 44 from the contact pressing spring 48, a closing operation of the mechanical part 20 is completed.

However, the conventional vertical type vacuum circuit breaker may have the following problems.

Firstly, a driving force of the mechanical part 20 is transferred to the contact pressing spring 48 via the rotation link 42 and the moveable link 43, thereby compressing the contact pressing spring 48 and allowing the moveable contact 14 to contact the fixed contact 12 by the compression force. Accordingly, the moveable link 43 receives a compression stress by a compression amount of the contact pressing spring 48 thus to be buckled. This may change a contact motion distance and a contact pressure when compared with initial design values of the vacuum circuit breaker. As a result, the vacuum circuit breaker may have a lowered reliability.

SUMMARY OF THE INVENTION

Therefore, an object of the present invention is to provide a vacuum circuit breaker capable of enhancing an insulation characteristic or a breaking performance by preventing deformation of a movable link which transfers a driving force of a driving unit by a contact pressing spring.

To achieve these and other advantages and in accordance with the purpose of the present invention, as embodied and broadly described herein, there is provided a vacuum circuit breaker, comprising: a main circuit part having a moveable contact and a fixed contact, and arranged at a frame in a vertical direction; a rotation shaft provided at one side of the main circuit part; a transfer lever coupled to the rotation shaft and rotating together with the rotation shaft; a connection lever rotatably coupled to the frame, coupled to the transfer lever, and rotating in an opposite direction to the rotation shaft; a conversion lever rotatably coupled to the frame, coupled to the connection lever, and rotating in an opposite direction to the connection lever; a moveable link coupled to the conversion lever, and horizontally moving according to a rotation direction of the rotation shaft; direction conversion links coupled between the moveable link and the moveable contact, and configured to convert a motion direction of the moveable contact according to a moving direction of the moveable link; and a contact pressing spring disposed between the moveable link and the direction conversion link, and configured to maintain a contacted state between the two contacts by generating an elastic force when the moveable link horizontally moves.

According to another aspect of the present invention, there is provided a vacuum circuit breaker, comprising: a main circuit part having a moveable contact and a fixed contact, and arranged at a frame in a vertical direction; a mechanical part provided at the frame, and configured to generate an operational force to connect or disconnect the circuit between the two contacts; a rotation link configured to convert a rotation force of a rotation shaft provided in the mechanical part into a horizontal motion force; a moveable link having one end rotatably connected to the rotation link, and horizontally moving according to a rotation direction of the rotation link; a direction conversion link coupled between the moveable link and the moveable contact, and configured to convert a motion direction of the moveable contact according to a moving direction of the moveable link; and a contact pressing spring disposed between the moveable link and the direction conversion link, and configured to maintain a contacted state between the two contacts by generating an elastic force when the moveable link horizontally moves, wherein the rotation link comprises a connection lever rotatably coupled to the frame; a transfer lever rotatably coupled to one end of the connection lever, and coupled to the rotation shaft; and a conversion lever rotatably connected to another end of the connection lever, and configured to generate a horizontal displacement by a horizontal displacement of the transfer lever in an opposite direction.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description of a vacuum circuit breaker according to the present invention will now be given in detail with reference to the accompanying drawings.

For the sake of brief description with reference to the drawings, the same or equivalent components will be provided with the same reference numbers, and description thereof will not be repeated.

Figure 1:
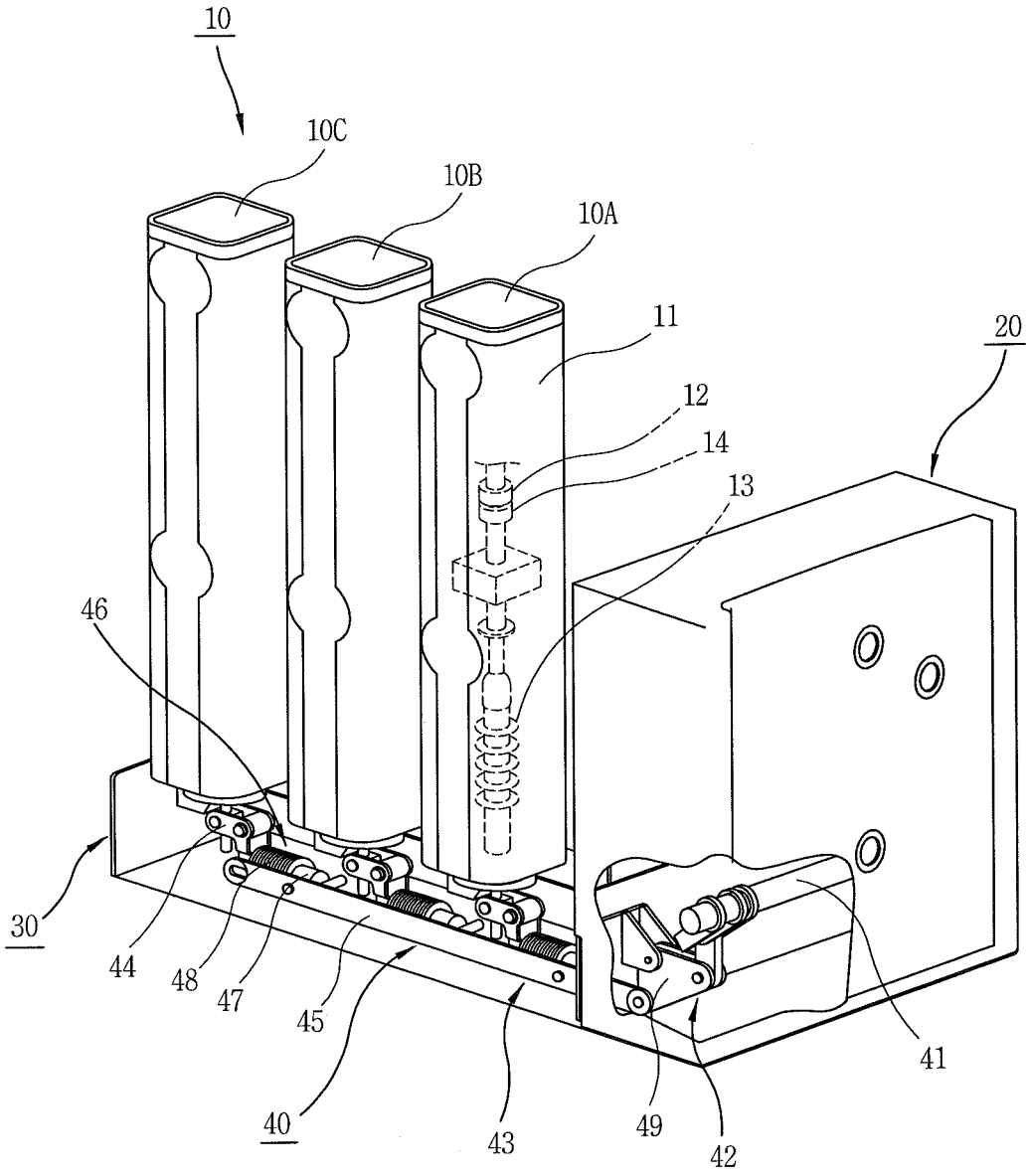
FIG. 1 PRIOR ART
FIG. 1 is a perspective view showing one example of a vertical type vacuum circuit breaker in accordance with the conventional art.
Figure 2:
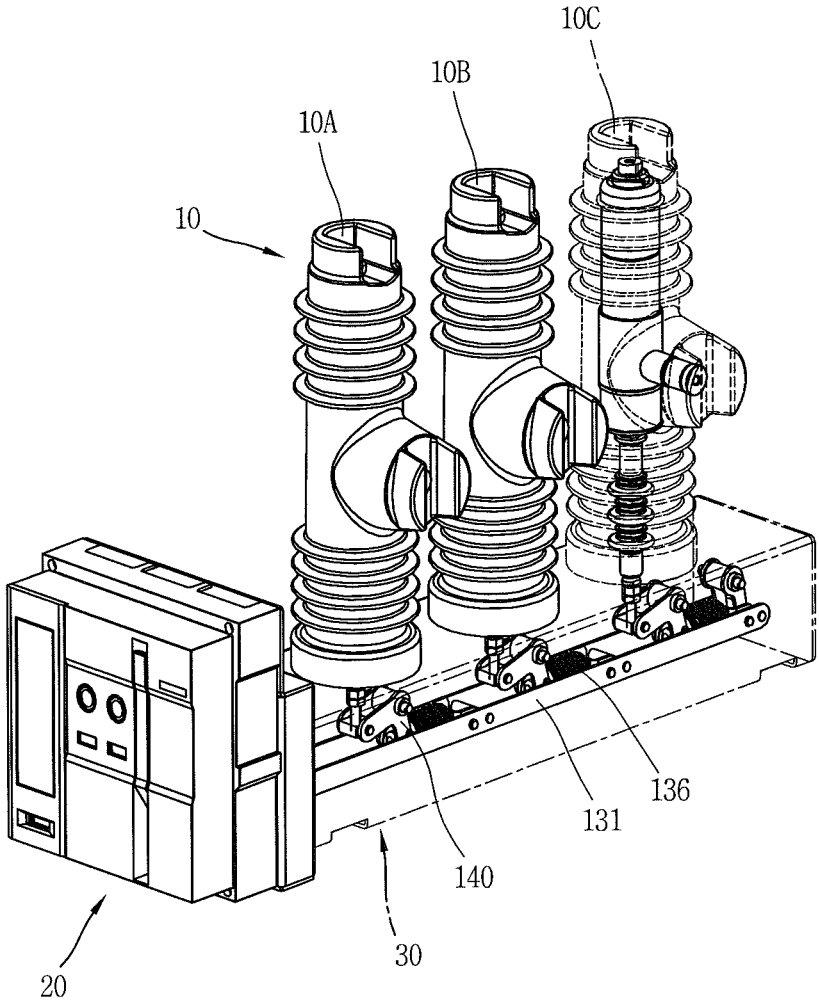
FIGS. 2 and 3 are front and rear perspective views showing one example of a vertical type vacuum circuit breaker according to the present invention.
Figure 3:
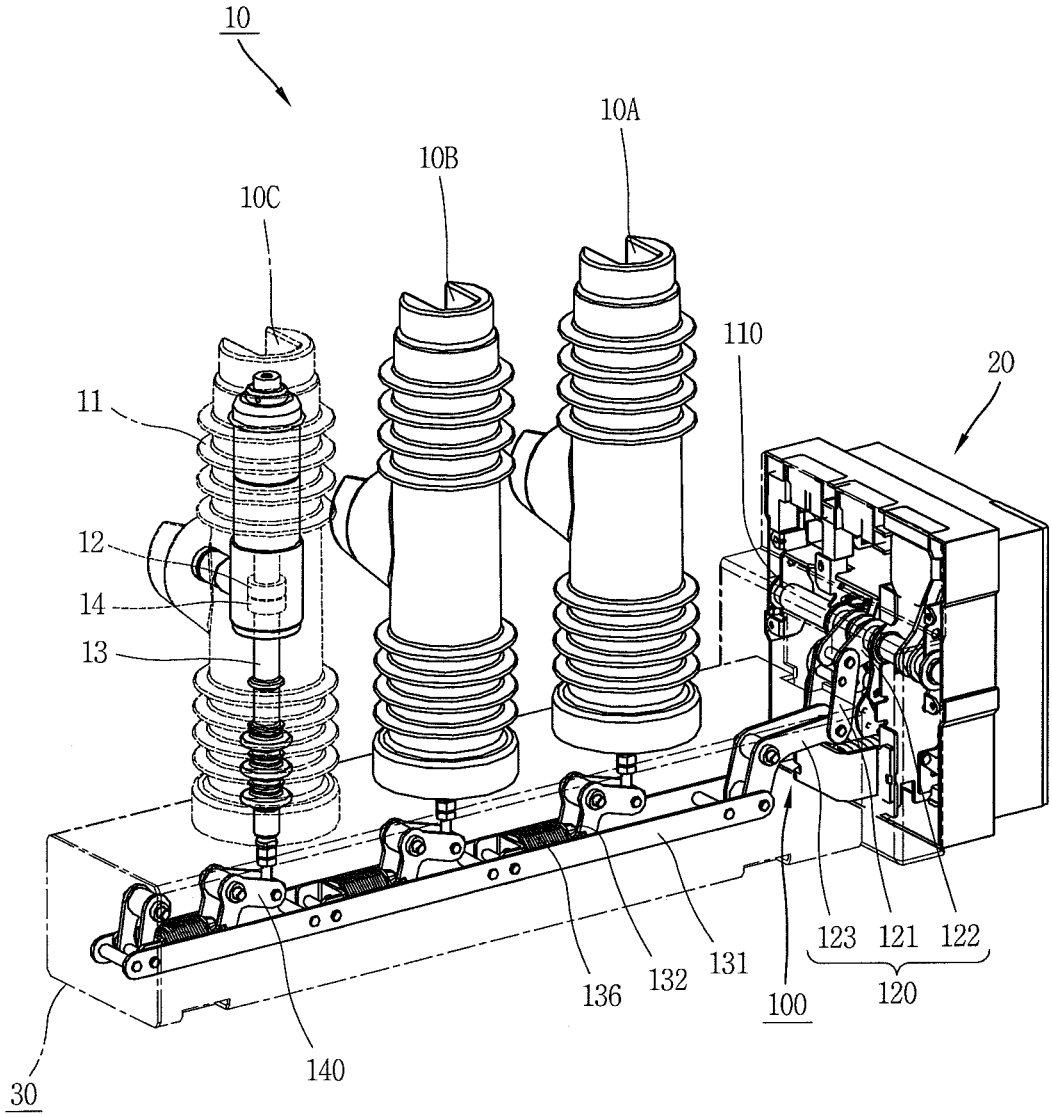
Figure 4:
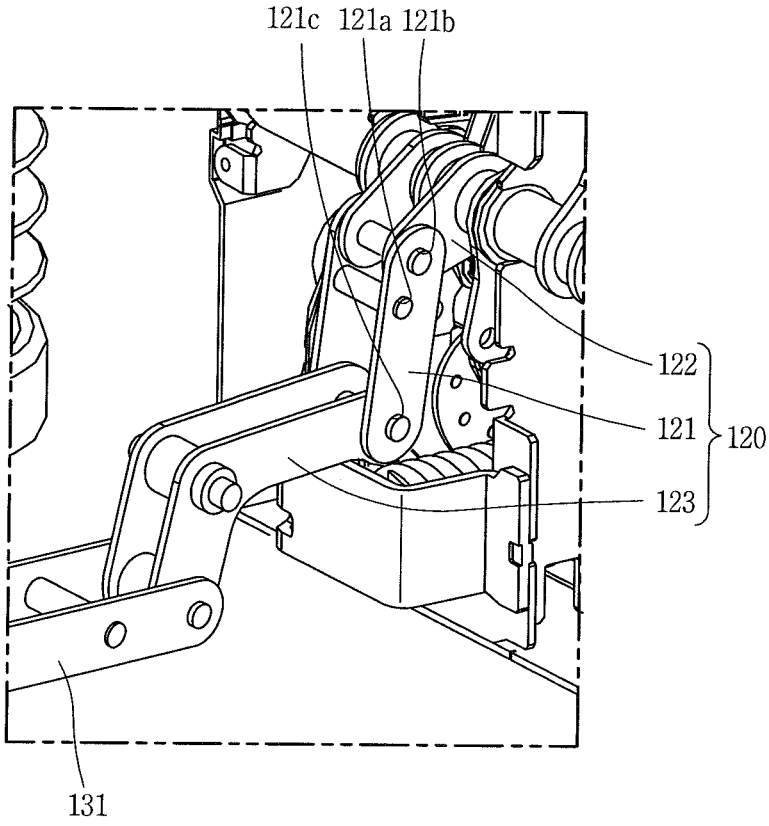
FIG. 4 is an enlargement perspective view of a part 'A' in FIG. 3.
Figure 5:
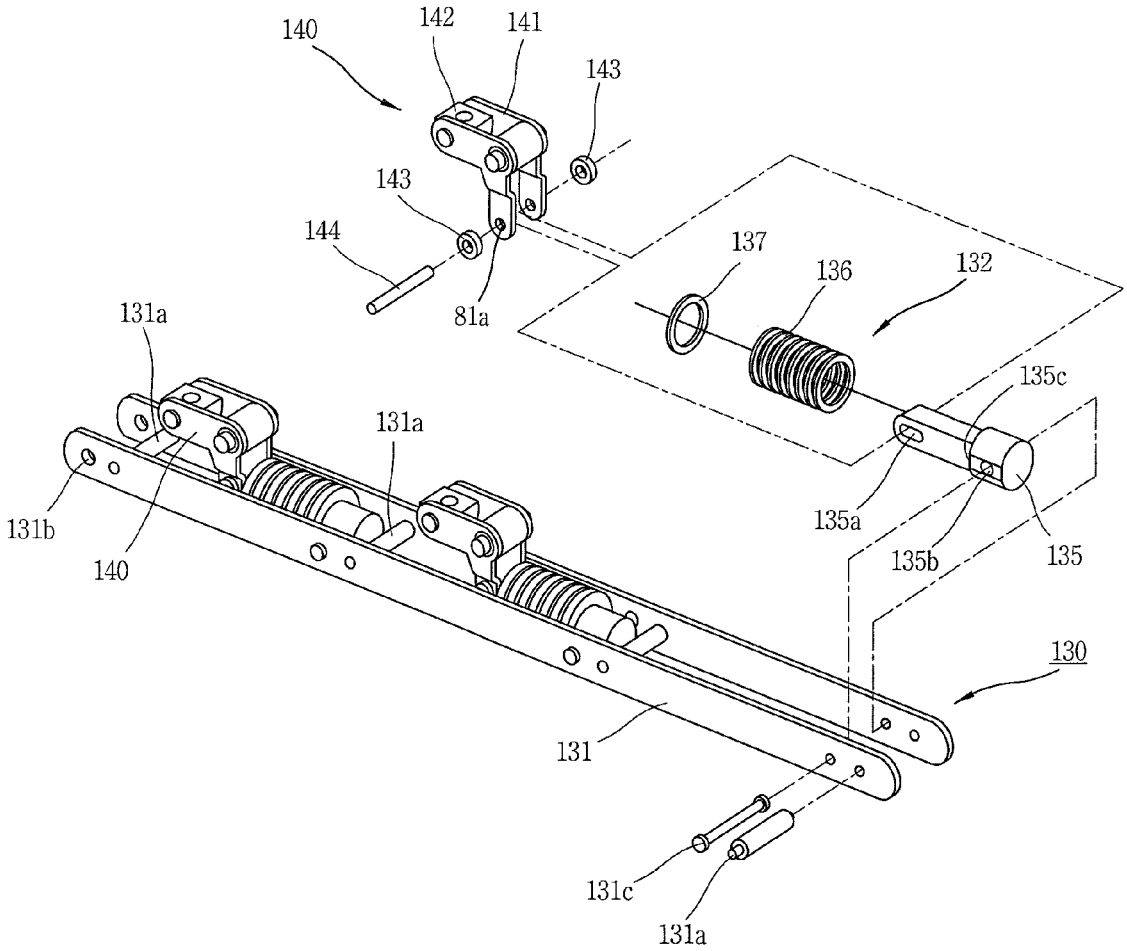
FIG. 5 is a disassembled perspective view of a movable link and a direction conversion link of a vacuum circuit breaker according to the present invention.

FIGS. 2 and 3 are front and rear perspective views showing one example of a vertical type vacuum circuit breaker according to the present invention, FIG. 4 is an enlargement perspective view of a part 'A' in FIG. 3, and FIG. 5 is a disassembled perspective view of a movable link and a direction conversion link of a vacuum circuit breaker according to the present invention.

As shown, the conventional vertical type vacuum circuit breaker comprises a main circuit part 10 having a moveable contact 14 and a fixed contact 12, and configured to conduct a main circuit and to break an abnormal current, a mechanical part 20 configured to generate an operational force so as to connect the circuit between the two contacts 12 and 14 of the main circuit part 10 to each other, or to disconnect the circuit from each other, a link frame 30 long installed below the mechanical part 20 and the main circuit part 10 in a horizontal direction, and a link unit 100 provided in the link frame 30, and configured to convert one rotation motion into a plurality of vertical motions while moving in a horizontal direction so as to transfer an operation force of the mechanical part 20 to the moveable contact 14 of the main circuit part 10.

The main circuit part 10 consists of three for R, S and T phases, and is fixedly-installed in a vertical direction above the link frame 30 from a backside of the mechanical part. Each of the main circuit parts 10A, 10B and 10C includes a main circuit housing 11 installed above the link frame 30 in a vertical direction, a fixed contact 12 positioned at an inner upper part of the main circuit housing 11, an insulation rod 13 connected to the link unit 100 and vertically moveable in the main circuit housing 11, and a moveable contact 14 fixed to an upper end of the insulation rod 13 and contacting or separated from the fixed contact 12 while vertically moving.

The link unit 100 includes a rotation shaft 110 provided in the mechanical part 20, a rotation link 120 configured to convert a rotation motion of the rotation shaft 110 into a linear motion force in a horizontal direction, a moveable link 130 having a fore end rotatably connected to the rotation link 120 and movable in a horizontal direction by being long connected to inside of the link frame 30, and direction conversion links 140 sequentially connected to the three main circuit parts 10 above the moveable link 130, and configured to convert a horizontal motion of the mechanical part 20 into a vertical motion of the main circuit part 10.

The rotation link 120 consists of a connection lever 121 rotatably coupled to the link frame 30 and coupled to the rotation shaft 110, a transfer lever 122 rotatably coupled to one end of the connection lever 121 and coupled to the rotation shaft 110, and a conversion lever 123 rotatably connected to another end of the connection lever 121 and configured to convert a rotation motion of the rotation shaft 110 into a linear motion of the sliding lever 131 by being connected to a sliding lever 131 to be later explained.

As shown in FIG. 4, the connection lever 121 is formed in a rectangular shape, and includes a first hinge hole 121, a second hinge hole 121*b* and a third hinge hole 121*c*. The first hinge hole 121*a* is formed at a middle part of the connection lever 121, and is rotatably coupled to the link frame 30. The second hinge hole 121*b* is formed at one end of the connection lever 121 so as to be rotatably coupled to the transfer lever 122. And, the third hinge hole 121*c* is formed at another end of the connection lever 121 so as to be rotatably coupled to the conversion lever 123. The first hinge hole 121*a* of the connection lever 121 is formed between the second hinge hole 121*b* and the third hinge hole 121*c*, and the first to third hinge holes 121*a*~121*c* are approximately formed on one line. However, the first hinge hole 121*a* and the second hinge hole 121*b* may be preferably formed not to be positioned on the same line as the center of the rotation shaft 110 so that the connection lever 121 coupled to the transfer lever 122 can rotate centering around the first hinge hole 121*a* by a rotation force of the rotation shaft 110 when being assembled with the transfer lever 122. More concretely, the first hinge hole 121*a* and the second hinge hole 121*b* are preferably arranged so that a center of the first hinge hole 121*a*, a center of the second hinge hole 121*b* and a center of the rotation shaft 110 form a triangular shape.

The transfer lever 122 is formed in a rectangular shape. One end of the transfer lever 122 is fixedly-coupled to the rotation shaft 110, whereas another end of the transfer lever 122 is hinge-coupled to the second hinge hole 121*b* of the connection lever 121.

The conversion lever 123 is formed in a '⌉' shape, and a bent portion positioned in the middle of the conversion lever 123 is rotatably coupled to the link frame 30. One end of the conversion lever 123 is rotatably coupled to the third hinge hole 121*c* of the connection lever 121, whereas another end thereof is rotatably coupled to one end of the sliding lever 131. Under these configurations, a rotation center of the conversion lever 122, a connection center of the conversion lever 122 to the connection lever 121, and a connection center of the conversion lever 122 to the moveable link 130 approximately form a triangular shape. Accordingly, when the connection lever 121 rotates, the conversion lever 123 rotates centering around a coupled part to the link frame 30 according to a rotation direction of the connection lever 121. This may allow the sliding lever 131 to move in a horizontal direction.

As shown in FIG. 5, the moveable link 130 includes a sliding lever 131 implemented as two long bars are fixed with a predetermined gap therebetween, and a guide link 132 disposed between the two bars of the sliding lever 131, configured to transfer a motion force of the sliding lever 131 in back and forth directions to the direction conversion links 140, and configured to provide a suitable compression force to the direction conversion links 140.

The two bars of the sliding lever 131 are fixed in parallel by a plurality of fixing pins 131*a*. Conversion holes 131*b* are formed at one end of the sliding lever 131 so as to be rotatably coupled to the conversion lever 123 of the rotation link 120.

The guide link 132 consists of a guide rod 135 and a contact pressing spring 136. The guide rod 135 has both ends rotatably connected to the sliding lever 131 and the direction conversion link 140, and has a slit 135*a* so as to horizontally perform a relative motion with respect to the direction conversion link 140. And, the contact pressing spring 136 is supported by the guide rod 135, and provides an elastic force in a direction to perform a relative motion with respect to the direction conversion link 140.

The guide rod 135 is provided with a pin hole 135*b* at the end thereof so as to be connected to the sliding lever 131 by a rotation pin 131*c*. And, a spring seat portion 135*c* having a stepped part and configured to support the contact pressing spring 136 is formed in the middle of the guide rod 135.

A supporting ring 137 is provided in front of the contact pressing spring 136 so as to perform a relative motion by being fitted into the guide rod 135 between the direction conversion link 140 and the contact pressing spring 136. The direction conversion link 140 is formed in a '⌉' shape. Here, an upper end of the direction conversion link 140 is connected to the insulation rod 13 of the main circuit part 10, and a lower end thereof is connected to the slit 135*a* of the guide rod 135 by a connection pin 144 so as to perform a rotation motion and a linear motion to some degree.

As shown in FIG. 5, the direction conversion link 140 is implemented as two plate bodies 141 having a '⌉' shape are connected to each other. A rotation joint 142 is installed between the two plate bodies 141 such that the insulation rod 130 performs a relative rotation with respect to the rotation joint 142 in a state that a lower end of the insulation rod 130 has been inserted into the rotation joint 142.

Rollers 143 are provided at both sides below the direction conversion link 140 so as to easily move in back and forth directions along the slit 135*a* of the guide rod 135. These rollers 143 are installed at both sides of the connection pin 144 which penetrates the direction conversion link 140 and the slit 135*a*.

The same parts as the conventional components will be provided with the same reference numerals.

The operation of the vacuum circuit breaker according to the present invention will be explained as follows.

Figure 6:
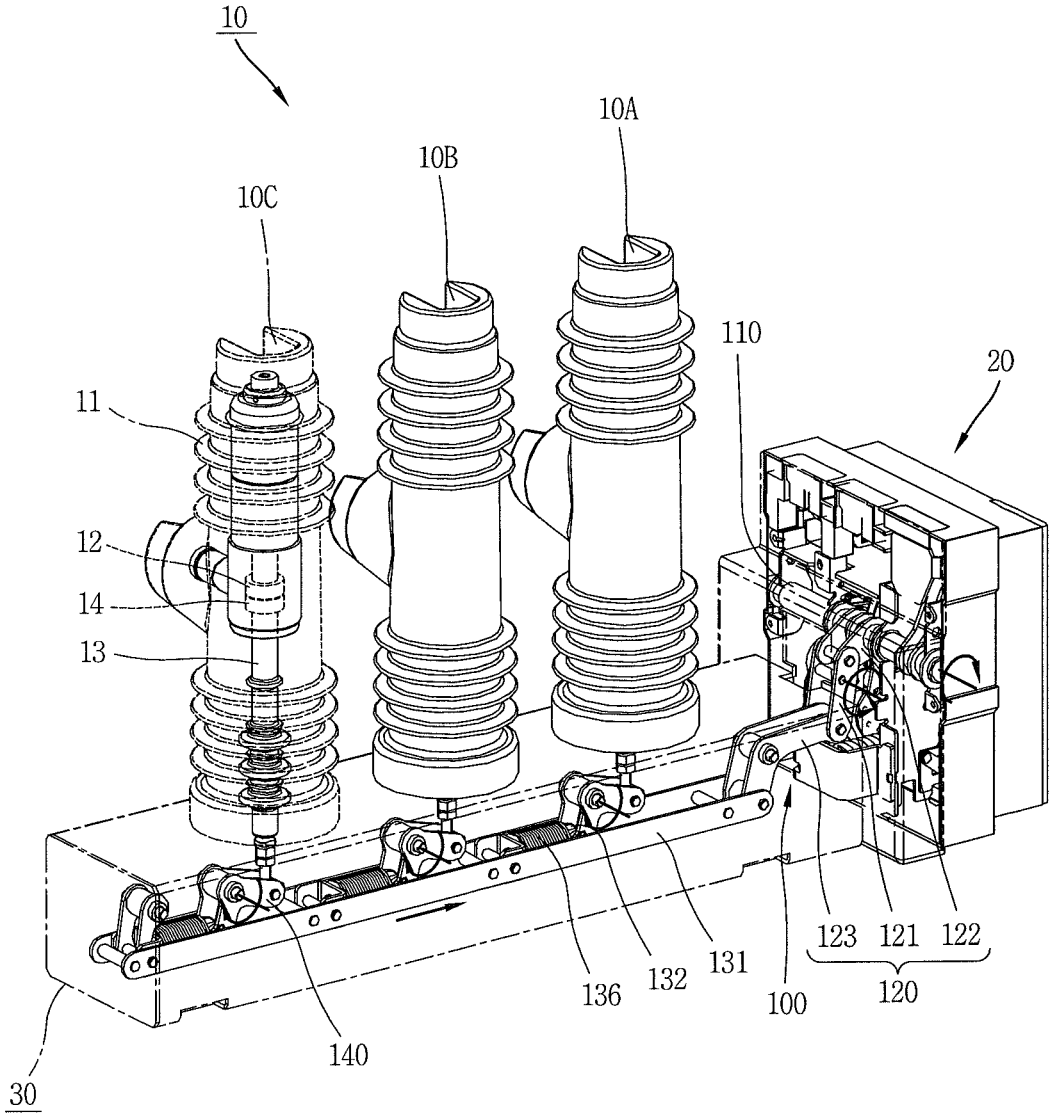
FIG. 6 is a perspective view showing a state that a sliding lever of the vacuum circuit breaker of FIG. 3 receives a tensile force.

As shown in FIG. 6, once the rotation shaft 110 rotates by an operation of the mechanical part 20, a rotation force of the rotation shaft 110 is converted into a linear force through the transfer lever 122, the connection lever 121 and the conversion lever 123. By this linear force, the moveable link 130 moves in a horizontal direction to simultaneously rotate the three direction conversion links 140.

As upper parts of the direction conversion links 140 rotate, each insulation rod 13 vertically moves upwardly in the main circuit part 10 to push up the moveable contact 14 thereby to contact the moveable contact 14 to the fixed contact 12. Accordingly, an operation force of the mechanical part 20 is transferred to the main circuit part 10 to allow a main circuit to be closed.

When the horizontal movable link 130 transfers the motion force received from the mechanical part 20 in back and forth directions, the same force and speed are provided to each direction conversion link 140 connected to the link frame 30 with the same interval. This may allow the moveable contact 14 and the fixed contact 12 inside each main circuit part 10A, 10B and 10C to contact each other with the same force.

If the rotation shaft 110 continues to rotate by an operational force of the mechanical part 20 even in a state that the moveable contact 14 and the fixed contact 12 come in contact with each other, the moveable link 130 continues to move to a front side, i.e., to a direction of the rotation shaft 110 by the rotation link 120. As the three guide rods 135 also move forwardly, the direction conversion links 140 compress the contact pressing spring 136 along the slit 135*a* of the guide rod 135. Then, the insulation rod 13 is upwardly pushed in a state that the contact pressing spring 136 maintains an elastic force. As the moveable contact 14 and the fixed contact 12 have a suitable contact force therebetween by the elastic force provided to the direction conversion links 140 from the contact pressing spring 136, a closing operation of the mechanical part 20 is completed.

While the connection lever 121 of the rotation link 120 rotates counterclockwise centering around the third hinge hole 121*c*, the connection lever 121 generates a force to pull the conversion lever 123 to a front side, i.e., to a direction of the rotation shaft. By this force, the sliding lever 131 of the moveable link 130 also receives a tensile force to be forwardly pulled.

As the sliding lever receives a tensile force during a closing operation of the mechanical part, the occurrence of buckling may be prevented. This may prevent lowering of the reliability due to deformation of the sliding lever.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A vacuum circuit breaker, comprising:

a main circuit part having a moveable contact and a fixed contact, and arranged at a frame in a vertical direction;

a rotation shaft provided at one side of the main circuit part;

a transfer lever coupled to the rotation shaft and rotating together with the rotation shaft;

a connection lever rotatably coupled to the frame, coupled to the transfer lever, and rotating in an opposite direction to the rotation shaft;

a conversion lever rotatably coupled to the frame, coupled to the connection lever, and rotating in an opposite direction to the connection lever;

a moveable link coupled to the conversion lever, and horizontally moving according to a rotation direction of the rotation shaft;

direction conversion links coupled between the moveable link and the moveable contact, and configured to convert a motion direction of the moveable contact according to a moving direction of the moveable link; and a contact pressing spring disposed between the moveable link and the direction conversion link, and configured to maintain a contacted state between the two contacts by generating an elastic force when the moveable link horizontally moves.

2. The vacuum circuit breaker of claim 1, wherein the connection lever is formed in a rectangular shape, and includes a first hinge hole formed at a middle part of the connection lever so as to be rotatably coupled to the frame, a second hinge hole formed at one side of the first hinge hole so as to be rotatably coupled to the transfer lever, and a third hinge hole formed at another side of the first hinge hole so as to be rotatably coupled to the conversion lever, wherein the first hinge hole, the second hinge hole and the third hinge hole are approximately formed on one line.

3. The vacuum circuit breaker of claim 2, wherein a center of the first hinge hole, a center of the second hinge hole and a center of the rotation shaft are arranged to form a triangular shape.

4. The vacuum circuit breaker of claim 1, wherein the conversion lever is formed in a '¬' shape, and a bent portion positioned in the middle of the conversion lever is rotatably coupled to the frame, wherein one end of the conversion lever is rotatably coupled to the connection lever, and another end thereof is rotatably coupled to the moveable link, wherein a rotation center of the conversion lever, a connection center of the conversion lever to the connection lever, and a connection center of the conversion lever to the moveable link approximately form a triangular shape.

5. The vacuum circuit breaker of claim 4, wherein the moveable link includes:

a plurality of sliding levers fixed with an interval there between; and guide rods disposed between the sliding levers, and having one end coupled to the sliding levers and another end coupled to the direction conversion links.

6. The vacuum circuit breaker of claim 5, wherein the guide rods are provided with slits such that the direction conversion links horizontally perform a relative motion with respect to the moveable link, and the contact pressing spring is inserted into the guide rods to be supported so as to elastically support the direction conversion links.

7. The vacuum circuit breaker of claim 6, wherein a supporting ring is provided between the direction conversion link and the contact pressing spring so as to perform a relative motion by being fitted into the guide rod, and a spring seat portion configured to support the contact pressing spring is formed at the guide rod.

8. The vacuum circuit breaker of claim 6, wherein rollers are provided at both sides of the direction conversion link so as to easily move in a horizontal direction along the slits of the guide rods.

9. The vacuum circuit breaker of claim 1, wherein the direction conversion link is implemented as two plate bodies are connected to each other, and a rotation joint is installed between the two plate bodies such that ends of the movable contact perform a relative rotation with respect to the direction conversion links.

10. A vacuum circuit breaker, comprising:

a main circuit part having a moveable contact and a fixed contact, and arranged at a frame in a vertical direction;

a mechanical part provided at the frame, and having a rotation shaft so as to transfer an operational force to connect or disconnect the circuit between the two contacts;

a rotation link configured to convert a rotation force of the rotation shaft provided in the mechanical part into a horizontal motion force;

a moveable link having one end rotatably connected to the rotation link, and horizontally moving according to a rotation direction of the rotation link;

a direction conversion link coupled between the moveable link and the moveable contact, and configured to convert a motion direction of the moveable contact according to a moving direction of the moveable link; and a contact pressing spring disposed between the moveable link and the direction conversion link, and configured to maintain a contacted state between the two contacts by generating an elastic force when the moveable link horizontally moves, wherein the rotation link comprises:

a connection lever rotatably coupled to the frame;

a transfer lever rotatably coupled to one end of the connection lever, and coupled to the rotation shaft; and a conversion lever rotatably connected to another end of the connection lever, and configured to generate a horizontal displacement by a horizontal displacement of the transfer lever in an opposite direction.

11. The vacuum circuit breaker of claim 10, wherein the connection lever is formed in a rectangular shape, and includes a first hinge hole formed in the middle of the connection lever so as to be rotatably coupled to the frame, a second hinge hole formed at one side of the first hinge hole so as to be rotatably coupled to the transfer lever, and a third hinge hole formed at another side of the first hinge hole so as to be rotatably coupled to the conversion lever, wherein the first hinge hole, the second hinge hole and the third hinge hole are approximately formed on one line.

12. The vacuum circuit breaker of claim 11, wherein a center of the first hinge hole, a center of the second hinge hole and a center of the rotation shaft are arranged to form a triangular shape.

13. The vacuum circuit breaker of claim 10, wherein the conversion lever is formed in a '¬' shape, a bent portion positioned in the middle of the conversion lever is rotatably coupled to the frame, one end of the conversion lever is rotatably coupled to the connection lever, and another end of the conversion lever is rotatably coupled to the moveable link, wherein a rotation center of the conversion lever, a connection center of the conversion lever to the connection lever, and a connection center of the conversion lever to the moveable link approximately form a triangular shape.

14. The vacuum circuit breaker of claim 13, wherein the moveable link includes:

a plurality of sliding levers fixed with an interval therebetween; and guide rods disposed between the sliding levers, and having one end coupled to the sliding levers and another end coupled to the direction conversion links.

15. The vacuum circuit breaker of claim 14, wherein the guide rods are provided with slits such that the direction conversion links horizontally perform a relative motion with respect to the moveable link, and the contact pressing spring is inserted into the guide rods to be supported so as to elastically support the direction conversion links.

16. The vacuum circuit breaker of claim 15, wherein a supporting ring is provided between the direction conversion link and the contact pressing spring so as to perform a relative motion by being fitted into the guide rod, and a spring seat portion configured to support the contact pressing spring is formed at the guide rod.

17. The vacuum circuit breaker of claim 15, wherein rollers are provided at both sides of the direction conversion link so as to easily move in a horizontal direction along the slits of the guide rods.

18. The vacuum circuit breaker of claim 10, wherein the direction conversion link is implemented as two plate bodies are connected to each other, and a rotation joint is installed between the two plate bodies such that ends of the movable contact perform a relative rotation with respect to the direction conversion links.

* * * * *